US006029306A

United States Patent [19]

Faraj

[11] Patent Number: 6,029,306

[45] Date of Patent: Feb. 29, 2000

[54] SCRUBBING AND WASHING TOOL

[76] Inventor: Abdul-Razzak Faraj, P.O. Box 566068, Atlanta, Ga. 31156

[21] Appl. No.: 09/182,611

[22] Filed: Oct. 29, 1998

[51] Int. Cl.[7] ..... A47L 13/12

[52] U.S. Cl. ..... 15/118

[58] Field of Search ..... 15/105, 118

[56] References Cited

U.S. PATENT DOCUMENTS

| | | | |
|---|---|---|---|
| 597,246 | 1/1898 | Pratt . | |
| 702,338 | 6/1902 | Boord . | |
| 1,035,250 | 8/1912 | Shannon . | |
| 2,687,542 | 8/1954 | Turausky . | |
| 2,896,243 | 7/1959 | Schoenfield | 15/118 |
| 5,940,924 | 8/1999 | Williams | 15/118 |

*Primary Examiner*—Randall E. Chin
*Attorney, Agent, or Firm*—John L. James

[57] ABSTRACT

A tool for scrubbing and washing a dish has a scrubber portion and a washer portion. The scrubber portion has a laterally extending base with a top and a bottom, an upright handle attached to the top of the scrubber base, and a scrubbing element attached to the bottom of the scrubber base. The washer portion also has a laterally extending base with a top and a bottom, an upright handle attached to the top of the washer base, and a washing element attached to the bottom of the washer base. The scrubber handle and the washer are positioned adjacent one another. An elastomeric grip encircles the scrubber and washer handles and retard grease migration up the handles.

12 Claims, 1 Drawing Sheet

SCRUBBING AND WASHING TOOL

FIELD OF THE INVENTION

The present invention relates to a hand tool for washing articles such as dishes.

BACKGROUND OF THE INVENTION

A dish cloth or sponge is often used for washing dishes. When washed promptly after use before food has an opportunity to dry, a dish cloth or simple sponge is sufficient. However, when foods such as egg yolks dry on a dish, a separate scrubber is required to remove the food. It is desirable to have a single simple implement that can both scrub and wash a dish.

SUMMARY OF THE INVENTION

Briefly summarized, according to one aspect of the invention, a tool for scrubbing and washing a dish has a scrubber portion and a washer portion. The scrubber portion has a laterally extending base with a top and a bottom, an upright handle attached to the top of the scrubber base, and a scrubbing element attached to the bottom of the scrubber base. The washer portion also has a laterally extending base with a top and a bottom, an upright handle attached to the top of the washer base, and a washing element attached to the bottom of the washer base. The scrubber handle and the washer are positioned adjacent one another.

A rubber grip on the handles prevents grease from migrating up the handles to keep grease off the hands. By releasably attaching the scrubbing and washing elements to the bases, the elements can be interchanged so that both elements are scrubbers forming a scrubbing tool, or both elements are washers forming a simple washing tool as desired. When the hand tool has a scrubber element and a washer element, it both scrubs and washes a dish simultaneously.

These and other aspects, objects, features and advantages of the present invention will be more clearly understood and appreciated form a review of the following detailed description of the preferred embodiments and appended claims, and by reference to the accompanying drawings.

DETAILED DESCRIPTION OF THE PREFERRED EMBODIMENTS

Figure 1:
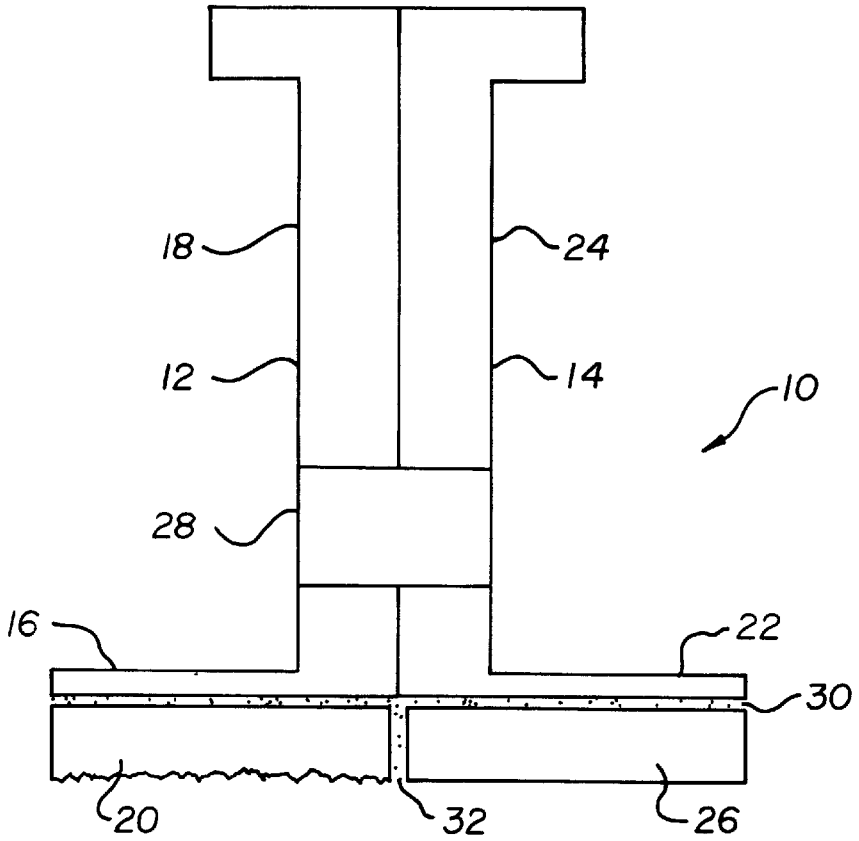
FIG. 1 is a diagrammatic front elevation view of a preferred embodiment of a combination scrubbing and washing tool according to the present invention.
Figure 2:
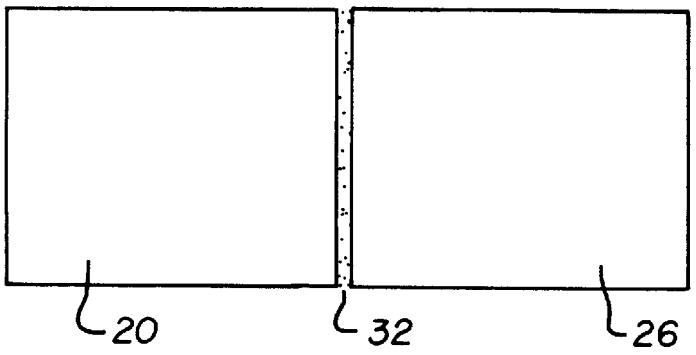
FIG. 2 is a bottom view of the scrubbing and washing tool.

Referring to FIGS. 1–2, a tool 10 for scrubbing and washing an article such as a dish contains a scrubber 12 and a washer 14. The scrubber 12 has a laterally extending base 16 with a top side and a bottom side, an upright handle 18 attached to the top side of the scrubber base 16, and a scrubbing element 20 attached to the bottom side of the scrubber base. The top end of the handle 18 extends laterally in the same direction as the scrubber base and parallel to the scrubber base so that it lies over the scrubber base. Similarly, the washer 14 has a laterally extending base 22 with a top side and a bottom side, an upright handle 24 attached to the top side of the washer base 22, and a washing element 26 attached to the bottom side of the scrubber base. The top end of the washer handle 24 extends laterally in the same direction as the washer base 22 and parallel to the washer base so that it lies over the washer base. The top ends of the handles act as a stop to prevent a wet slippery tool from slipping out of the hand.

A grip 28, constructed of rubber or other elastomeric material, fits snugly about handles 18, 24 near the bases 16, 22 to retard migration of grease along the handle during use when the scrubber 12 and washer 14 abut one another. The bases and handles are preferably constructed of plastic but wood or other material may be used. The handles 18, 24 can be held in abutting contact with one another by the rubber grip 28 or can be secured with screws, adhesive, a key and keyway, or other fastener.

The bottom surface of the scrubber base 16 has scrubber element 20 attached thereto. Scrubbing element 20 may be a scrubbing sponge which is rough textured to loosen dried food, or may be a loose woven synthetic material that substitutes for steel wool. Such scrubbing devices and materials are well known. The bottom surface of the washer base 22 has washing element 26 attached thereto. Washing element 26 is preferably a cellulose or other soft sponge material.

The scrubbing and washing elements 20, 26 are attached to the bases by a first fastening means 30. Fastening means 30 may be a waterproof adhesive that secures each element to its respective base. The scrubbing and washing elements may also be attached to one another along their adjacent abutting edges by a second fastening means 32.

During use the scrubbing and cleaning elements may wear. It is desirable to releasably mount the elements so that replacement of a worn element is possible. Fastening means 30, 32 may be hook and loop fasteners that facilitate easy replacement of a worn element. With hook and loop fasteners, it is possible to replace one or both elements, or to change a scrubbing element for a washing element as desired.

It can now be appreciated that a combination dish scrubbing and washing tool has been presented that is simpler to use than separate scrubbers and cleaners. The actual scrubbing and washing elements may be releasably mounted for repair or replacement of an individual element, or for interchanging elements to convert the tool to either a scrubber or cleaner for a particular washing chore.

While the invention has been described with particular reference to the preferred embodiments, it will be understood by those skilled in the art that various changes may be made and equivalents may be substituted for elements of the preferred embodiments without departing from invention. For example, the base members could be semicircular to form a circular cleaning head or may have other configurations than the rectangular cleaning head illustrated.

As is evident form the foregoing description, certain aspects of the invention are not limited to the particular details of the examples illustrated, and it is therefore contemplated that other modifications and applications will occur to those skilled in the art. For example, the handle surface may contain vertical, horizontal or diagonal ribs or other devices to aid in gripping the tool. It is accordingly intended that the claims shall cover all such modifications and applications as do not depart form the true spirit and scope of the invention.

What is claimed is:

1. A tool for scrubbing and washing an article, comprising:

a scrubber having a laterally extending base with a top and a bottom, an upright handle attached to said top of said scrubber base, and a scrubbing element attached to said bottom of said scrubber base;

a washer having a laterally extending base with a top and a bottom, an upright handle attached to said top of said washer base, and a washing element attached to said bottom of said washer base, said scrubber handle and said washer being positioned adjacent one another; and an elastomeric grip encircling said scrubber and washer handles.

2. A scrubbing and washing tool, as set forth in claim 1, wherein said elastomeric grip is positioned near said bases to prevent grease form migrating up said handles.

3. A scrubbing and washing tool, as set forth in claim 1, wherein said scrubbing element is a scrubbing sponge.

4. A scrubbing and washing tool, as set forth in claim 1, wherein said scrubbing element is a scouring pad.

5. A scrubbing and washing tool, as set forth in claim 1, wherein said washing element is a sponge.

6. A scrubbing and washing tool, as set forth in claim 1, including a hook and loop fastener attaching said scrubbing and washing elements to said bases.

7. A scrubbing and washing tool, as set forth in claim 6, including a hook and loop fastener along adjacent edges of said scrubbing and washing elements attaching said elements to one another.

8. A scrubbing and washing tool, as set forth in claim 1, wherein said scrubbing and washing elements are attached to said bases with an adhesive.

9. A scrubbing and washing tool, as set forth in claim 1, wherein said scrubbing and washing elements are releasably attached.

10. A scrubbing and washing tool, as set forth in claim 1, wherein said scrubbing and washing elements are interchangeable.

11. A scrubbing and washing tool, as set forth in claim 1, wherein a top end of said washer handle extends laterally and parallel to said scrubber base so that it lies over said scrubber base.

12. A scrubbing and washing tool, as set forth in claim 1 wherein a top end of said scrubber handle extends laterally and parallel to said washer base so that it lies over said washer base.

* * * * *